US008876570B2

(12) United States Patent
Seitz

(10) Patent No.: US 8,876,570 B2
(45) Date of Patent: Nov. 4, 2014

(54) METHOD FOR PRODUCING AN ELECTRODE FOR A HIGH-PRESSURE DISCHARGE LAMP AND HIGH-PRESSURE DISCHARGE LAMP COMPRISING AT LEAST ONE ELECTRODE THUS PRODUCED

(75) Inventor: Wolfgang Seitz, Eichstaett (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/883,723

(22) PCT Filed: Oct. 28, 2011

(86) PCT No.: PCT/EP2011/069030

§ 371 (c)(1),
(2), (4) Date: May 6, 2013

(87) PCT Pub. No.: WO2012/059435

PCT Pub. Date: May 10, 2012

(65) Prior Publication Data

US 2013/0221842 A1 Aug. 29, 2013

(30) Foreign Application Priority Data

Nov. 5, 2010 (DE) ..... 10 2010 043 463

(51) Int. Cl.

| | |
|---|---|
| ***H01J 9/00*** | (2006.01) |
| ***H01J 61/073*** | (2006.01) |
| ***H01J 9/04*** | (2006.01) |
| ***H01J 1/20*** | (2006.01) |

(52) U.S. Cl.

CPC ..... *H01J 9/042* (2013.01); *H01J 61/0732* (2013.01); *H01J 2201/19* (2013.01); *H01J 2209/02* (2013.01); *H01J 9/04* (2013.01); *H01J 1/20* (2013.01)

USPC ..... 445/46; 445/35

(58) Field of Classification Search

CPC ..... H01J 9/025; H01J 9/027; H01J 9/042; H01J 61/0732; H01J 61/073; H01J 9/02; H01J 9/04; H01J 61/0675

USPC ..... 313/633; 445/3, 46, 51, 49, 50, 2, 35, 445/38

See application file for complete search history.

(56) References Cited

U.S. PATENT DOCUMENTS

| | | | |
|---|---|---|---|
| 2003/0048078 | A1 | 3/2003 | Fukuyo et al. |
| 2006/0220559 | A1 | 10/2006 | Ikeuchi |
| 2010/0079048 | A1 | 4/2010 | Ishikawa |

FOREIGN PATENT DOCUMENTS

| | | |
|---|---|---|
| DE | 721 503 | 6/1942 |
| JP | 06-000664 | 1/1994 |
| JP | 7 065712 | 3/1995 |
| JP | 2002-008587 | 1/2002 |
| JP | 2002-117806 | 4/2002 |
| JP | 2005-123161 | 5/2005 |

(Continued)

OTHER PUBLICATIONS

English Language Translation of WO 2008090030A1, Jul. 2008.*

*Primary Examiner* — Nimeshkumar Patel
*Assistant Examiner* — Glenn Zimmerman
(74) *Attorney, Agent, or Firm* — Cozen O'Connor

(57) ABSTRACT

A method for producing an electrode (16) for a high-pressure discharge lamp (10), comprising the following steps: a) scanning at least part of the electrode surface for producing an oxide layer (step 120); b) at least partially sublimating the oxide layer formed in step a) (step 120); and c) reducing the rest of the oxide layer.

18 Claims, 4 Drawing Sheets

(56) References Cited

FOREIGN PATENT DOCUMENTS

| | | | |
|---|---|---|---|
| JP | 2006464533 | | 6/2006 |
| JP | 2007-522608 | | 8/2007 |
| JP | 2010-086855 | | 4/2010 |
| JP | 2010-129498 | | 6/2010 |
| WO | WO 2008090030 | A1 * | 7/2008 |

* cited by examiner

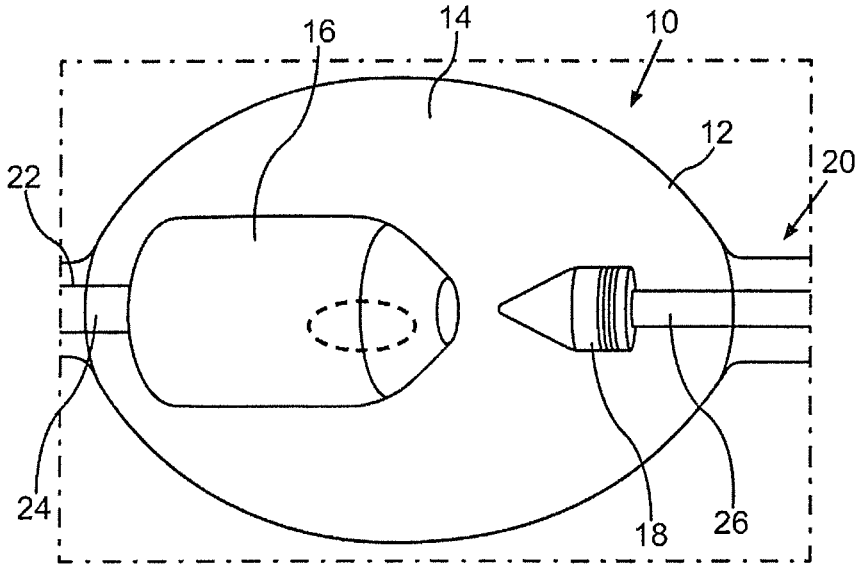
Fig.1
FIG 3
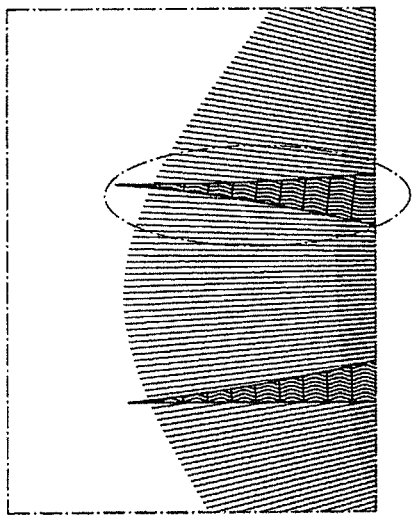

METHOD FOR PRODUCING AN ELECTRODE FOR A HIGH-PRESSURE DISCHARGE LAMP AND HIGH-PRESSURE DISCHARGE LAMP COMPRISING AT LEAST ONE ELECTRODE THUS PRODUCED

RELATED APPLICATIONS

This is a U.S. nations stage of International application No. PCT/EP2011/069030 file on Oct. 28, 2011.

This patent application claims the priority of German application no. 10 2010 043 463.9 filed Nov. 5, 2010, the disclosure content of which is hereby incorporated by reference.

FIELD OF THE INVENTION

The present invention relates to a method for producing an electrode for a high-pressure discharge lamp. It further relates to a high-pressure discharge lamp comprising at least one electrode thus produced.

BACKGROUND OF THE INVENTION

The emissivity of electrodes of discharge lamps has a decisive influence on the performance and the geometrical design of such discharge lamps.

The prior art is represented by paste coating with metal powders or mixtures of materials by means of an organic binder and subsequent sintering in or caking onto the electrode body. However, the layer which has been pasted and sintered in is less resistant in mechanical terms, and this can lead to partial crumbling upon contact.

WO 2008/090030 A1 discloses a method for processing an electrode of a discharge lamp. In this case, the electrode is oxidized in the region in which it is pinched in a gas-tight manner in the neck of a discharge space formed from glass. The oxidation is effected chemically in a normal air atmosphere and at ambient air pressure at a temperature of between 700 and 1300 K. The oxide layer is then sublimated in a vacuum environment, the temperature during the sublimation being between 1450 K and 1900 K. This procedure provides the electrode with a surface of fine roughness in said region, as a result of which the adhesion of the surface of this electrode portion to the discharge vessel material is reduced. As a result, the risk of cracking in the sealed region of the discharge vessel is reduced. During the sublimation step, possible contamination is also removed from the surface of the electrode portion with the oxide layer, as a result of which the adhesion is likewise reduced.

U.S. Pat. No. 6,626,725 B1 discloses a discharge lamp in which a rod-shaped electrode consisting of tungsten is introduced in certain regions into a neck of a discharge vessel through a gas-tight pinch seal and extends in certain regions into a discharge space of the discharge vessel. In order to make it possible to prevent cracking of the discharge vessel in the region of the pinch seal during operation of the discharge lamp, the surface of the electrode is processed. To produce an elemental tungsten layer on the surface of the electrode in the length region in which the electrode is arranged in the region of the pinch seal, an oxide layer is firstly produced on the surface. In this respect, a tungsten trioxide layer can be produced, for example. In order to produce the elemental tungsten layer, the oxidized electrode is then heated at about 1200° C. in a hydrogen furnace, in which hydrogen bubbles through water.

EP 1 251 548 A1 teaches a method for improving the thermal radiation properties of electrodes in a high-pressure discharge lamp of the short arc type. For this purpose, grooves are made in the surface of the electrodes. The grooves have a depth which is less than/equal to 12% of the electrode diameter, the ratio between the depth and the spacing of the grooves being greater than/equal to two. A laser apparatus can be used for making the grooves. The grooves can have an angular or curved form, with curved grooves being produced by grinding the surface and then electrolytically polishing it in a 10% strength sodium hydroxide solution. Curved grooves can, however, also be produced by heating to a high temperature in a vacuum, for example by heating the surface at 2000° C. for 120 min.

SUMMARY OF THE INVENTION

One object of the present invention is to provide a method for producing an electrode for a high-pressure discharge lamp with which it is possible to achieve the highest possible emissivity for the electrodes. In this case, the surface of the electrode should be as resistant as possible in mechanical terms. Another object of the present invention is to provide a high-pressure discharge lamp comprising at least one electrode thus produced.

The present invention is based on the understanding that it is possible in principle to achieve a high emissivity when the electrode has an improved thermal radiation behavior. The thermal radiation behavior can be improved by enlarging the surface of the electrode. In this context, it has to be ensured, however, that the conductivity of the electrode is not impaired despite the enlarged surface of the electrode.

According to an embodiment of the invention, therefore, firstly at least part of the electrode surface is scanned for producing an oxide layer using a high-energy beam suitable therefor, for example an electromagnetic beam, in particular a laser beam, or an electron or ion beam. By appropriately selecting the energy density, at least part of the oxide layer which forms is already sublimated in the process. What is obtained as an intermediate result is an electrode surface which, although already extremely rough, is oxidic, i.e. has a reduced conductivity. For this reason, the non-sublimated oxide layer is reduced to form the metal in a following step. This results in an extremely rough surface having a high emissivity, it being possible to set the emissivity depending on the structuring and oxidation. The surface which forms is very strong and very resistant in mechanical terms. In addition, in contrast to the paste coating variant known from the prior art, no additional contamination is introduced.

In contrast to producing an oxide layer chemically, even only partial regions can be oxidized in the method according to the invention. This is particularly advantageous for defining different functional regions on the electrode.

Compared to the defined introduction of grooves as per the teaching of EP 1 251 548 A1, as mentioned above, a very much larger surface can be produced by the method according to the invention and therefore a considerably higher emissivity can be realized.

In step a), the scanning is preferably effected at least on a part of the electrode which, after the electrode has been mounted in the glass bulb of the high-pressure discharge lamp, is not embedded in the glass of the glass bulb. Since the processing can be limited to the part of the electrode which is important for the emission, time is saved and therefore the production costs are reduced. Step a) is preferably carried out in atmosphere, in particular in an oxygen-enriched atmosphere. Since the electrode usually consists predominantly of tungsten, i.e. in particular of doped tungsten, and tungsten is highly reactive toward oxygen, tungsten oxide can thus be easily produced.

It is furthermore preferable that step b) is performed at the same time as step a). During the scanning, some of the tungsten oxide therefore already changes into the gaseous state by sublimation, whereas another portion of the tungsten oxide remains on the surface of the electrode.

Step c) is preferably performed in a hydrogen-containing atmosphere, in particular in an argon/hydrogen mixture. A preferred argon/hydrogen mixture is known by the name VARIGON®. This makes it possible in a particularly simple manner for the oxygen from the tungsten oxide to be joined with the hydrogen from the atmosphere in which step c) is carried out to form water. The pure metal remains on the electrode surface.

As already mentioned, the electrode preferably comprises tungsten, tungsten oxide being reduced to form pure tungsten in step c).

The scanning in step a) is preferably effected by means of a laser beam apparatus. Precisely that part of the electrode surface which is important for the emissivity can thereby be processed in a particularly precise manner. In contrast to chemical processing, different regions of the electrode surface can be scanned differently. By varying the modifications which are brought about on the electrode surface by means of the laser beam apparatus, a further optimization can be made with respect to a high emissivity. With respect to the settable parameters, such as energy density, line spacing, focus and the like, scanning by means of a laser beam apparatus makes it possible to precisely set a desired emissivity.

In this context, the laser beam apparatus is designed in particular to release an energy density which makes it possible for at least part of the electrode surface to be melted, oxidized and sublimated.

In this case, in step a), the laser beam apparatus can be clocked at a frequency of between 1 kHz and 100 kHz, in particular 10 kHz. Lines with a spacing of between 0.01 and 0.2 mm, in particular 0.1 mm, between two adjacent lines are preferably produced on the electrode surface in step a). The laser beam apparatus is preferably operated with a laser beam focus of between 0.01 and 0.1 mm, in particular 0.02 mm. In this way, the electrode surface can be maximized, as a result of which the emissivity of the electrode is simultaneously at a maximum.

Alternatively, the scanning can also be effected using other suitable beam apparatuses, such as for example electron or ion beam apparatuses.

According to a preferred embodiment of the method according to the invention, step c) is carried out at a temperature of between 700° C. and 2500° C., in particular 2200° C. Step a), by contrast, is preferably carried out at ambient temperature, in particular at a temperature of between 15° C. and 30° C., and at ambient pressure.

Further preferred embodiments become apparent from the dependent claims.

The preferred embodiments which have been described with reference to the method according to the invention and the advantages thereof similarly apply, where applicable, to the high-pressure discharge lamp according to the invention comprising at least one electrode thus produced.

BRIEF DESCRIPTION OF THE DRAWINGS

Exemplary embodiments of the present invention will be described in more detail hereinbelow with reference to the accompanying drawings, in which:

FIG. 1 shows, in a schematic illustration, a high-pressure discharge lamp according to the invention;

FIG. 3 shows a section of the anode of the high-pressure discharge lamp shown in FIG. 1;

PREFERRED EMBODIMENT OF THE INVENTION

Figure 2:
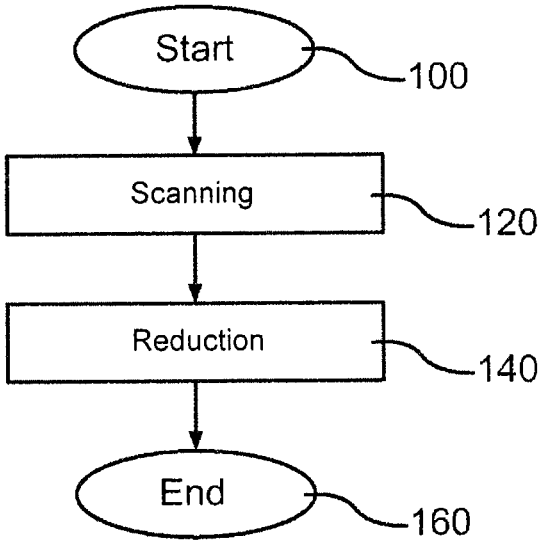
FIG. 2 shows a signal flowchart for an exemplary embodiment of a method according to the invention.

FIG. 1 schematically shows a section of a high-pressure discharge lamp 10. The high-pressure discharge lamp 10 comprises a discharge vessel 12 having a discharge space 14. A first electrode 16 (anode) and a second electrode 18 (cathode) extend into the discharge space 14. Two diametrically opposed necks 20, 22 adjoin the central part, of oval cross section, of the discharge vessel 12. The electrode 16 is fused in the neck 22, and the electrode 18 is fused in the neck 20.

The electrodes 16, 18 are arranged on rods 24, 26 which are preferably formed from tungsten or a tungsten alloy. The electrodes 16, 18 themselves consist of doped tungsten.

The method according to the invention is explained in more detail using the example of the electrode 16, i.e. the anode. Embodiments in which the cathode is processed moreover in accordance with the method according to the invention are of course conceivable.

The method begins with step 100. In step 120, at least part of the surface of the electrode 16 is scanned by means of a laser beam apparatus. The energy density here is so high that some of the electrode surface melts, oxidizes and sublimates. This means that some of the tungsten oxide which forms changes into the gaseous state, whereas another portion of the tungsten oxide remains on the electrode surface. Step 120 is preferably carried out in an oxygen-enriched atmosphere. The laser beam apparatus can be clocked at a frequency of between 1 kHz and 100 kHz, in particular 10 kHz. It is preferable that lines with a spacing of between 0.01 and 0.2 mm, in particular 0.1 mm, between two adjacent lines are produced on the electrode surface. In a preferred embodiment, the laser beam apparatus is operated with a laser beam focus of between 0.01 and 0.1 mm, in particular 0.02 mm. The laser beam apparatus can emit a power of between 50 W and 200 W, preferably approximately 120 W, for example. The scanning can be effected at a speed of between 10 mm/s and 100 mm/s, in particular 30 mm/s, for example. The temperature can be ambient temperature; the pressure is preferably ambient pressure.

A preferred laser beam apparatus is known by the name rofin rsmarker and is operated with a galvo head. The power in this exemplary embodiment is approximately 120 W, as a result of which a current of approximately 38 A flows. The scanning speed is approximately 30 mm/s.

The electrode 16 is preferably rotatably mounted, such that the entire circumference can be structured by the laser beam apparatus.

Step 120 forms a very rough oxidic surface. This is not defined geometrically, as will be explained in even more detail further below with reference to the further figures.

In step 140, the electrode 16 is heated preferably inductively in a VARIGON atmosphere. As a result, the oxidized parts of the surface are reduced to form metallic tungsten and water by the hydrogen present. What is obtained as a result is a metallic, very rough electrode surface having an emissivity which can be set by way of the degree of treatment. The surface is free of contamination since, in contrast to the prior art, no binder has to be used in a paste coating process. The electrode has a very good coupling-in behavior upon inductive heating and is mechanically stable, i.e. the electrode surface shows no tendency to crumble. Step 140 is preferably carried out at a temperature of between 700° C. and 2500° C., in particular 2200° C.

The method according to the invention ends with step 160.

Electrodes having an emissivity of up to 0.6 for the surface produced can be produced by the method according to the invention. The range which could be reached with paste coating in the prior art is therefore even slightly exceeded.

FIG. 3 shows a magnified view of that region of the surface of the electrode 16 shown in FIG. 1 in which the shape changes from cylindrical to conical. The magnification is 10:1. Clearly identifiable are the tracks of the laser processing, in particular also the overlapping regions of the laser structure, which were formed by the beam running out upon application of the parallel lines in the conical region of the electrode 16.

Figure 4:
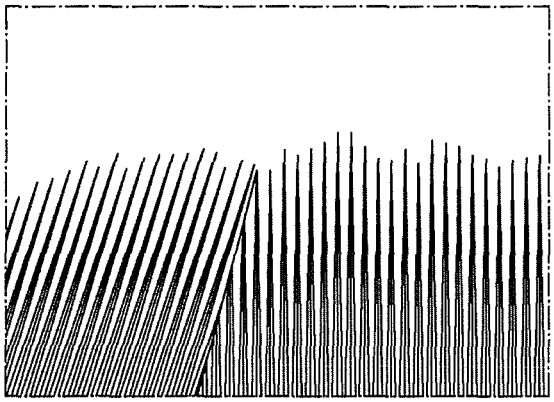
FIG. 4 shows a first magnified illustration of a first section of the electrode surface shown in FIG. 3.

FIG. 4 shows a magnified illustration of a section of FIG. 3 in the cylindrical-conical transition region. The magnification is 1:30. With the same magnification, FIG. 5 shows a section of FIG. 3 in the cylindrical region.

Figure 5:
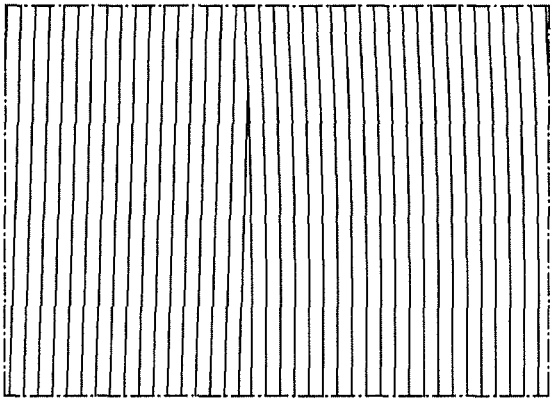
FIG. 5 shows a first magnified illustration of a second section of the electrode surface shown in FIG. 3.
Figure 6:
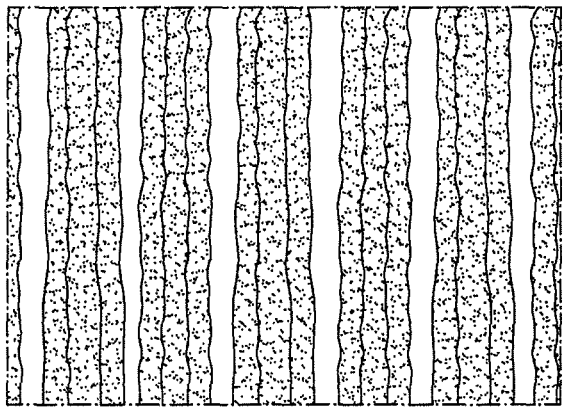
FIG. 6 shows a magnified illustration of the section shown in FIG. 5.

With further magnification to the factor 1:200, FIG. 6 shows an enlarged section of the illustration in FIG. 5. Ribs can clearly be seen, with the irregularity of the surface being eye-catching. The irregularity results in a considerable enlargement of the electrode surface, as a result of which high emissivities can be achieved.

Figure 7:
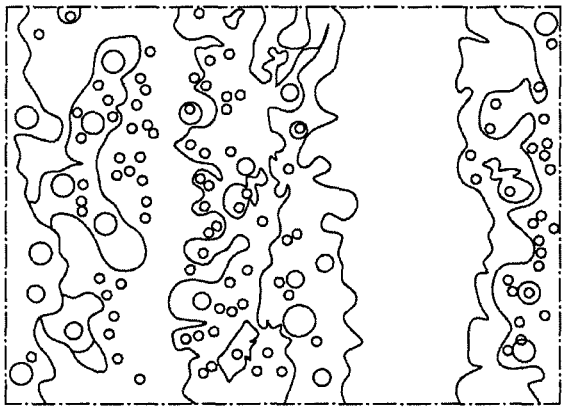
FIG. 7 shows a magnified illustration of the section shown in FIG. 6.

FIG. 7, finally, shows the detail of a rib from the illustration of FIG. 6. The magnification is 1:1000.

This illustration underlines the high roughness of the tungsten surface of the electrode.

The invention claimed is:

1. A method for producing an electrode for a high-pressure discharge lamp, comprising the following steps:

a) scanning at least part of the electrode surface for producing an oxide layer;

b) at least partially sublimating the oxide layer formed in step a); and c) reducing the rest of the oxide layer.

2. The method as claimed in claim 1, wherein in step a), the scanning is effected at least on a part of the electrode which, after the electrode has been mounted in a glass bulb of the high-pressure discharge lamp, is not embedded in the glass of the glass bulb.

3. The method as claimed in claim 1, wherein step a) is carried out in atmosphere.

4. The method as claimed in claim 1, wherein step b) is performed at the same time as step a).

5. The method as claimed in claim 1, wherein step c) is performed in a hydrogen-containing atmosphere, in particular in an argon/hydrogen mixture.

6. The method as claimed in claim 1, wherein the electrode comprises tungsten, tungsten oxide being reduced to form pure tungsten in step c).

7. The method as claimed in claim 1, wherein the scanning in step a) is effected by means of a laser beam, electron beam or ion beam apparatus.

8. The method as claimed in claim 7, wherein the laser beam, electron beam or ion beam apparatus is designed to release an energy density which makes it possible for at least part of the electrode surface to be melted, oxidized and sublimated.

9. The method as claimed in claim 7, wherein in step a), the laser beam apparatus is clocked at a frequency of between 1 kHz and 100 kHz.

10. The method as claimed in claim 7, wherein lines with a spacing of between 0.01 and 0.2 mm between two adjacent lines are produced on the electrode surface in step a).

11. The method as claimed in claim 7, wherein the laser beam apparatus is operated with a laser beam focus of between 0.01 and 0.1 mm.

12. The method as claimed in claim 1, wherein step c) is carried out at a temperature of between 700° C. and 2500° C.

13. The method as claimed in claim 1, wherein step a) is carried out at ambient temperature, in particular at a temperature of between 15° C. and 30° C., and at ambient pressure.

14. The method as claimed in claim 1, wherein step a) is carried out in an oxygen-enriched atmosphere.

15. The method as claimed in claim 1, wherein step c) is performed in an argon/hydrogen mixture.

16. The method as claimed in claim 7, wherein lines with a spacing of 0.1 mm between two adjacent lines are produced on the electrode surface in step a).

17. The method as claimed in claim 7, wherein the laser beam apparatus is operated with a laser beam focus of 0.02 mm.

18. The method as claimed in claim 1, wherein step c) is carried out at a temperature of 2200° C.

* * * * *